US005440459A

United States Patent [19]

Chan

[11] Patent Number: 5,440,459

[45] Date of Patent: Aug. 8, 1995

[54] CEILING FAN HAVING A LIGHT ASSEMBLY

[76] Inventor: Bobby Chan, No. 199 Sec. 2 Feng Shr Road, Feng Yuan City, Taichung, Taiwan

[21] Appl. No.: 354,033

[22] Filed: Dec. 6, 1994

[51] Int. Cl.[6] ..... F21V 33/00

[52] U.S. Cl. ..... 362/96; 362/294; 416/5

[58] Field of Search ..... 362/96, 216, 260, 294; 416/5

[56] References Cited

U.S. PATENT DOCUMENTS 2,201,153 5/1940 Brown ..... 362/96
5,079,684 1/1992 Lai ..... 362/96
5,195,870 3/1993 Liu ..... 362/96
5,302,083 4/1994 Bucher et al. ..... 362/96

*Primary Examiner*—James C. Yeung
*Attorney, Agent, or Firm*—Morton J. Rosenberg; David I. Klein

[57] ABSTRACT

A ceiling fan includes a housing having a number of sockets disposed on the upper portion for engaging with lamps. A shaft extends upward from the housing for securing a lamp shade. A control box is secured to the lower portion of the housing and has a number of sockets for engaging with bulbs. A pole extends downward from the control box for securing another lamp shade. The lamp shades include either an open bottom portion or an open upper portion for air circulation purposes.

1 Claim, 5 Drawing Sheets

CEILING FAN HAVING A LIGHT ASSEMBLY

BACKGROUND OF THE INVENTION

1. Field of the Invention

The present invention relates to a ceiling fan, and more particularly to a ceiling fan having a light assembly.

2. Description of the Prior Art

Typical ceiling fans comprise a body having a number of blades rotatably coupled to the lower portion of the body. A number of the ceiling fans also include a number of lamps either disposed in the body or attached to the lower portion of the control box lighting purposes.

The present invention has arisen to mitigate and/or obviate the afore-described disadvantages of the conventional ceiling fans.

SUMMARY OF THE INVENTION

The primary objective of the present invention is to provide a ceiling fan including a light assembly disposed on top and on bottom for lighting purposes.

In accordance with one aspect of the invention, there is provided a ceiling fan comprising a housing including an upper portion and a lower portion, at least one socket disposed on the upper portion of the housing for engaging with lamps, a shaft extended upward from said upper portion of the housing, a first lamp shade secured to the shaft for covering the lamps, a control box secured to the lower portion of the housing, at least one socket secured to the control box for engaging with bulbs, a pole extended downward from the control box, and a second lamp shade secured to the pole for covering the bulbs. The first lamp shade includes an open bottom portion and the second lamp shade includes an open upper portion for air circulation purposes.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
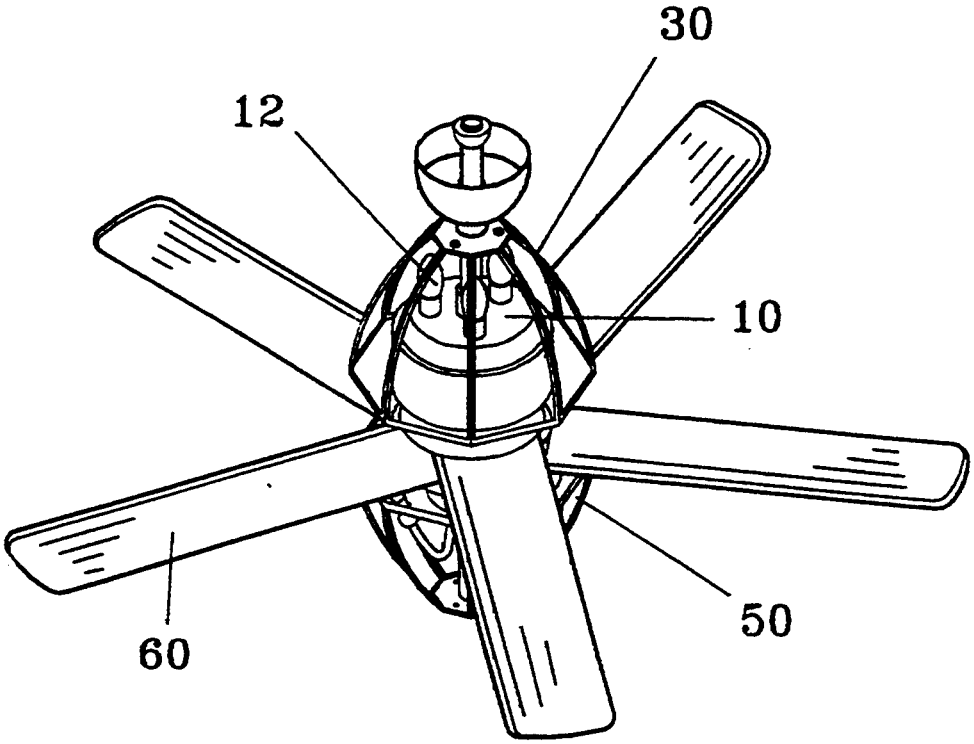
FIG. 1 is a perspective view of a light assembly for a ceiling fan in accordance with the present invention.
Figure 2:
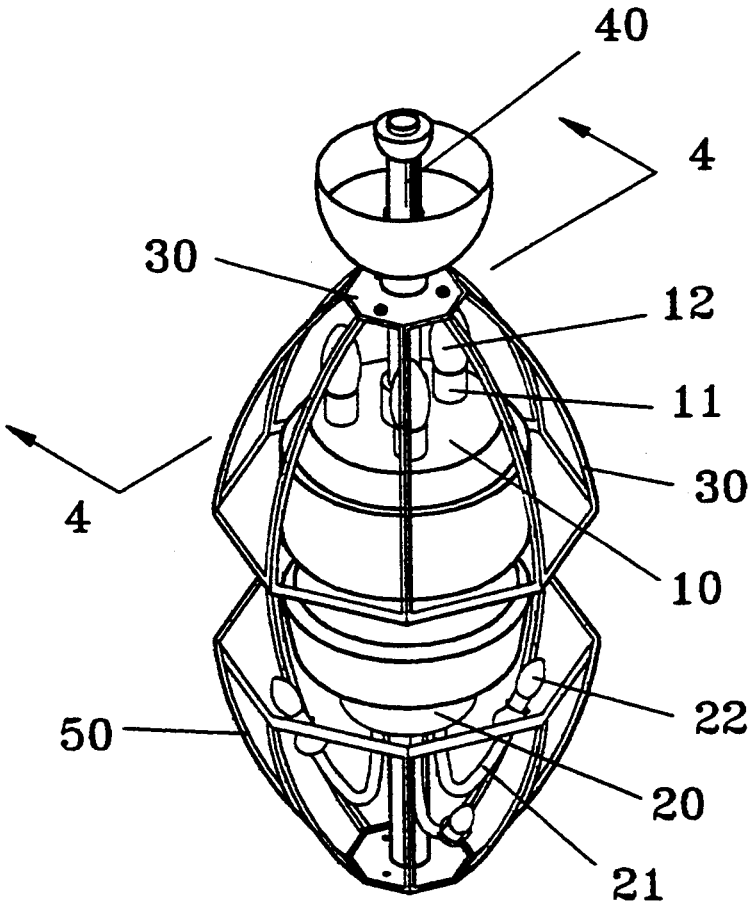
FIG. 2 is an enlarged perspective view of the light assembly.
Figure 3:
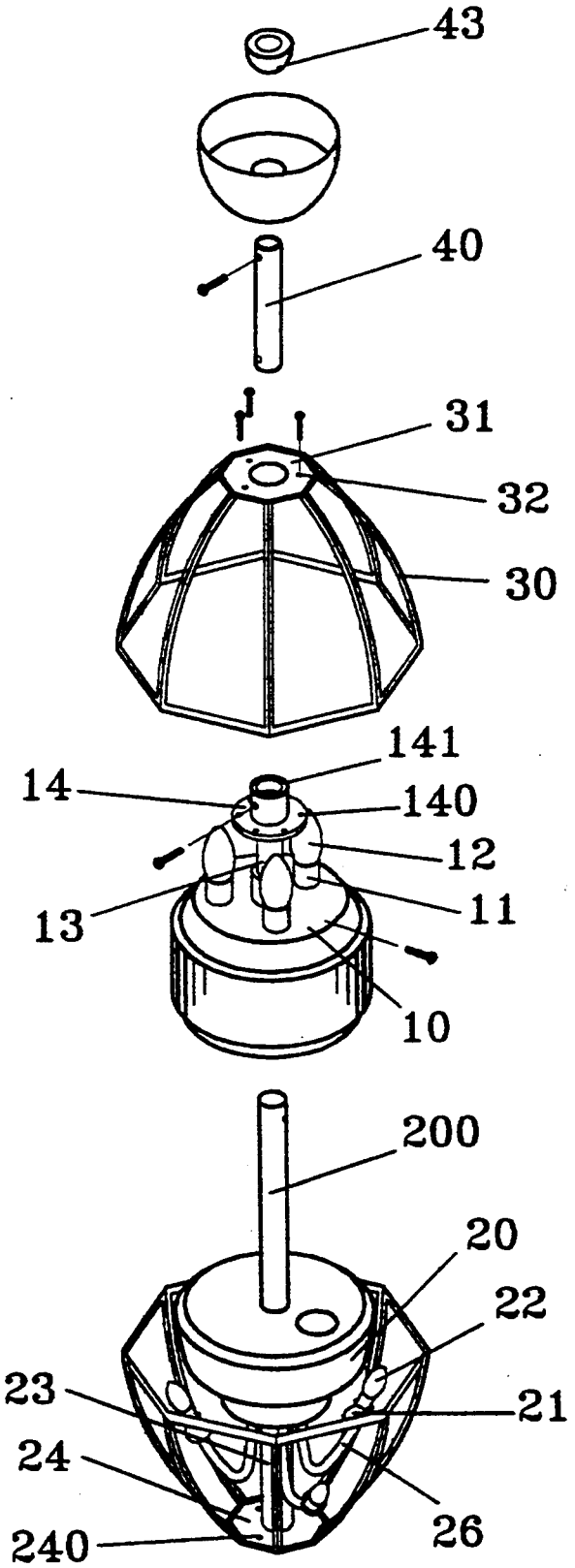
FIG. 3 is an exploded view of the ceiling fan.
Figure 4:
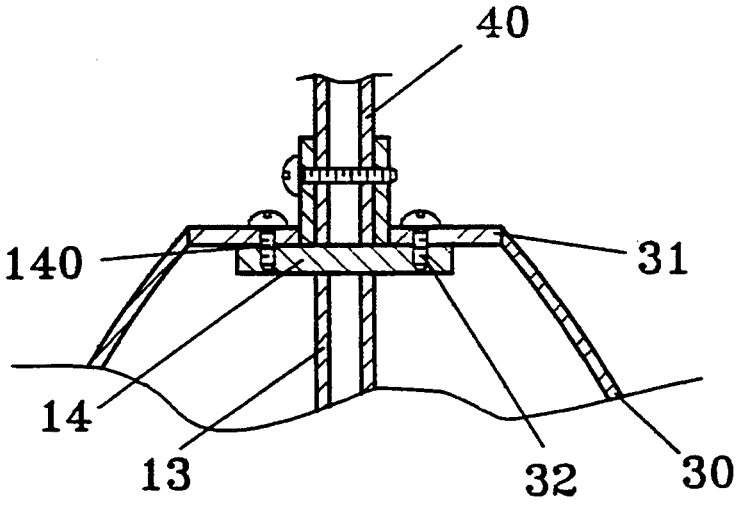
FIG. 4 is a partial cross sectional view taken along lines 4—4 of FIG. 2.

Referring to the drawings, and initially to FIGS. 1 to 3, a ceiling fan in accordance with the present invention comprises a housing 10 including a number of blades 60 rotatably coupled to the lower portion thereof in a conventional way and and including a motor disposed therein for driving the blades 60. The housing 10 includes a number of sockets 11 secured on top of the housing 10 for engaging with a number of lamps 12. A shaft 13 extends upward from the housing 10 and includes a disc 14 secured on top thereof. A hub 141 is provided on top of the disc 14 for engaging with a rod 40 (FIG. 4) which has a coupling element 43 secured on top for rotatably securing to a support member in a conventional way, in which the support member is secured to the ceiling. A lamp shade 30 is engaged on the lamps 12 and includes a flat top 31 having a number of screw holes 32 formed therein for engaging with screws which also engage with the holes 140 of the disc 14 so as to secure the lamp shade 30 to the disc 14.

A control box 20 is secured to the housing 10 by a shaft 200 in a conventional way and includes a pole 23 extended downward therefrom. A disc 24 is fixed on the bottom of the pole 23 and includes a number of screw holes 240 formed therein for engaging with screws. Another lamp shade 50 is secured to the disc 24 by screws. A number of U-shaped supports 26 includes one end secured to the control box 20 and includes another end extended upward for supporting a number of sockets 21 which are provided for engaging with bulbs 22.

Figure 5:
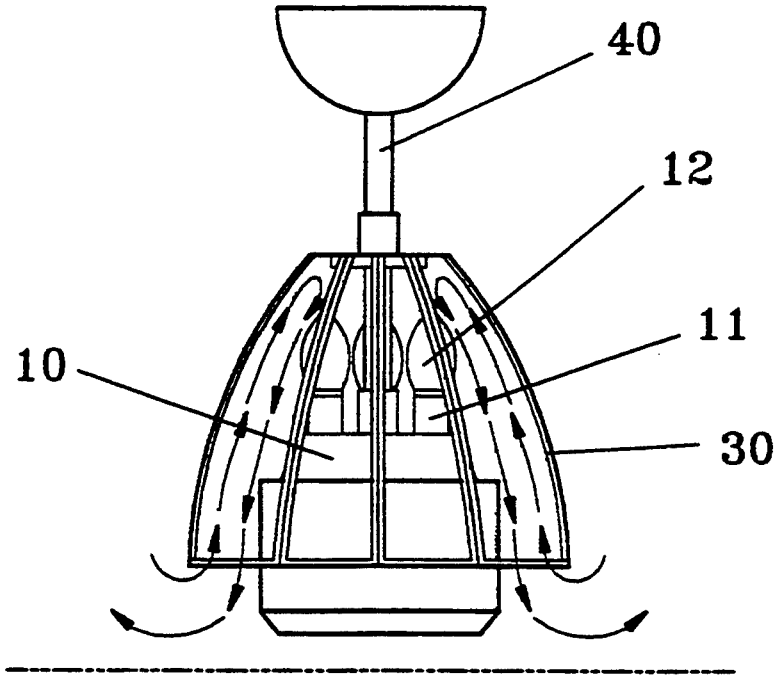
FIG. 5 is a schematic view illustrating the air circulation for the light assembly.

The lamp shade 30 covers the lamps 12 and includes an open bottom portion, best shown in FIG. 5; and the lamp shade 50 covers the bulbs 22 and includes an open upper portion, best shown in FIG. 3, such that air circulation may be generated or formed within the lamp shades 30, 50 for heat dissipation purposes.

Accordingly, the ceiling fan in accordance with the present invention includes a light assembly disposed on both the top and the bottom portion of the ceiling fan for lighting purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A light assembly for a ceiling fan, comprising:

a housing including an upper portion and a lower portion, said lower portion enclosing a motor and a plurality of fan blades rotatably coupled to said motor;

at least one first lamp socket disposed on said upper portion of said housing for engagement with a respective first lamp;

a shaft extending upward from said upper portion of said housing;

a first lamp shade secured to said shaft for covering said lamps, said first lamp shade having an open bottom portion for circulation of air therein;

a control box secured to said lower portion of said housing;

at least one second lamp socket secured to said control box for engagement with a respective second lamp;

a pole extending downward from said control box; and, a second lamp shade secured to said pole for covering said second lamp, said second lamp shade having an open upper portion for circulation of air therein.

* * * * *